US005408300A

United States Patent [19]

Wataki et al.

[11] Patent Number: 5,408,300

[45] Date of Patent: Apr. 18, 1995

[54] IMAGE-TRANSFER AND SHEET-SEPARATION APPARATUS

[75] Inventors: Ryuji Wataki, Nara; Shigeo Fujita, Moriguchi, both of Japan

[73] Assignee: Mita Industrial Co., Ltd., Osaka, Japan

[21] Appl. No.: 958,733

[22] Filed: Oct. 9, 1992

[30] Foreign Application Priority Data

Oct. 18, 1991 [JP] Japan ..... 3-271064

[51] Int. Cl.[6] ..... G03G 15/14

[52] U.S. Cl. ..... 355/276; 355/274; 355/277; 355/315

[58] Field of Search ..... 355/274, 276, 277, 271, 355/315; 271/307, 310, 900

[56] References Cited

U.S. PATENT DOCUMENTS

| | | | |
|---|---|---|---|
| 3,860,857 | 1/1975 | Namiki et al. | 355/276 |
| 4,081,212 | 3/1978 | Wetzer | 355/274 |
| 4,190,348 | 2/1980 | Friday | 355/274 |
| 4,353,648 | 11/1982 | Tanaka et al. | 355/315 |
| 4,363,550 | 12/1982 | Toshimitsu et al. | 355/315 |
| 4,431,301 | 2/1984 | Hashimoto et al. | 355/274 |
| 4,449,808 | 5/1984 | Abreu | 355/274 |
| 4,903,081 | 2/1990 | Takahashi | 355/274 |
| 5,006,902 | 4/1991 | Araya | 355/271 |
| 5,101,238 | 3/1992 | Creveling et al. | 355/271 |
| 5,101,239 | 3/1992 | Nishikawa et al. | 355/274 |
| 5,132,654 | 7/1992 | Walgrove, III et al. | 355/315 |

FOREIGN PATENT DOCUMENTS

| | | | |
|---|---|---|---|
| 0147152 | 11/1981 | Japan | 355/276 |
| 0044472 | 3/1983 | Japan | 355/276 |
| 0181364 | 10/1984 | Japan | 355/277 |
| 0018972 | 1/1986 | Japan | 355/276 |
| 0090675 | 4/1987 | Japan | 355/274 |
| 0096983 | 5/1987 | Japan . | |
| 2204508 | 11/1988 | United Kingdom | 355/274 |

OTHER PUBLICATIONS

Abstract of Japan, vol. 10, No. 330 (P-514) (2386) published Nov. 11, 1986 for Japanese Patent Application No. JP-A-61 137 178, Jun. 24, 1986.

Xerox Disclosure Journal, vol. 1, No. 5, May 1976, p. 83, by Fletcher et al. entitled "High Frequency Pulsed Bias Roller Transfer System."

Xerox Disclosure Journal, vol. 4, No. 2, Apr. 1979, p. 143, by Bruce W. Friday entitled "Lead Edge Transfer Switching."

*Primary Examiner*—Robert B. Beatty

*Attorney, Agent, or Firm*—Beveridge, DeGrandi, Weilacher & Young

[57] ABSTRACT

An image-transfer and sheet-separating apparatus transfers an image toner-developed from a positive latent image and retained on a photoconductor drum onto a copy sheet, and subsequently separates the sheet from the photoconductor drum. A sheet peel-separating AC voltage and an image-transferring DC bias voltage is applied to a transfer roller which presses on the photoconductor drum. The AC voltage is applied to the transfer roller when a transport-forward end of the sheet is located between the transfer roller and the photoconductor drum, and subsequently the DC voltage is applied to the transfer roller. A post image-transfer charge-stripping element removes charge from the copy sheet and is disposed in a portion of the sheet-transport stream forward of a nipping position at which the transfer roller presses against the photoconductor drum. Thus, charge remaining on the copy sheet is discharged, ensuring high efficiency in image transfer and accordingly reducing the incidence of failure in the separation of the copy sheet from the photoconductor drum.

19 Claims, 6 Drawing Sheets

IMAGE-TRANSFER AND SHEET-SEPARATION APPARATUS

BACKGROUND OF THE INVENTION

The present invention relates to an image-transfer and sheet-separating apparatus; more particularly to an apparatus for transferring onto a copy sheet an image, retained on an Image receiver, toner-developed from a positive latent image, and for separating the sheet holding the transferred image from the image receiver.

An image forming apparatus such as a copying machine will include an image-transfer and sheet-separating apparatus for transferring onto a copy sheet a lower image formed on a photoconductor drum serving as an image receiver. Conventional image-transfer and sheet-separating apparatus have an image-transfer charger for supplying a copy sheet with charge of reversed polarity to that carried by the toner, received from a corona charger, and a sheet-separating charger which functions by applying an alternating-current voltage to the copy sheet. One undesirable side effect in the conventional apparatus is, however, that environmentally undesirable ozone is generated by the corona charger.

Therefore, an image-transfer and sheet-separating apparatus employing a transfer roller and discharging unit in place of a corona charger has been taught, as has been disclosed in, for example, Japanese Laid-Open Patent Application No. 269969/1989.

The apparatus therein adopts a negative development process, by which toner is adhered to discharged (i.e., image-negative) areas of a photoconductor drum through an electric field generated by development electrodes. A DC bias voltage of reversed polarity to that of the toner adhered to the photoconductor drum is applied to the transfer roller. A copy sheet is then transported between the photoconductor drum and the transfer roller, which presses the sheet against the drum, whereupon the toner-developed image on the photoconductor drum is transferred onto the sheet by agency of the DC bias voltage applied to the transfer roller. The sheet holding the transferred image is discharged by a charge-stripping needle provided adjacent the transfer roller.

With negative-image development, adhesion of toner to the photoconductor drum is of sufficiently reduced strength as to enable image transfer at low bias voltages. Additionally, adhesion of the sheet to the photoconductor drum is such that it detaches easily merely by being discharged with the charge-stripping needle.

However, it is difficult to adapt the foregoing structure to apparatus employing positive-image development, in which toner is adhered to the charge-existing areas of the photoconductor drum. This is explained as follows.

In order to produce copies of appropriate image density, image forming apparatus employing positive-image development will not transfer toner-developed images optimally unless the bias voltage is high enough to overcome the electrostatic attraction of the toner, carrying charge of reversed polarity to that of the latent image, to the photoconductor drum. However, wherein high bias voltages are used, the charge-stripping needle is incapable of reliably stripping sufficient charge from the copy sheet, degrading the sheet-separating function. In particular, wherein the copy sheet receives scant toner, or is blank, the sheet-separating ability deteriorates to the extent that jamming occurs frequently, since the high bias voltage on the sheet attracts it to the largely discharged surface of the photoconductor drum.

SUMMARY OF Tile INVENTION

It is an object of the present invention to improve the reliability of the function of separating a copy sheet from an image receiver, meanwhile maintaining optimal image transfer.

An image-transfer and sheet-separating apparatus according to an aspect of the present Invention transfers onto a copy sheet an image retained on an image receiver, toner-developed developed from a positive latent image, and subsequently separates the image-holding sheet from the image receiver. In this apparatus, AC voltage superimposed on DC voltage is applied to a transfer roller which presses on the image receiver. Additionally, a charge-stripping element, which removes charge from the copy sheet, is disposed in a portion of the sheet-transport stream forward of a nipping position of the transfer roller and the image receiver.

In this image-transfer and sheet-separating apparatus, when the copy sheet is nipped between the image receiver and the transfer roller, the image retained on the Image receiver, toner-developed from a positive latent image, is transferred to the sheet by agency of DC voltage and the sheet is electrically discharged by an AC voltage. Furthermore, charge remnant on the sheet after the image transfer process is removed by the charge-stripping element disposed in a portion of the sheet-transport stream forward of the nipping position. Accordingly, charge remaining on the copy sheet is drawn off, ensuring high efficiency in image transfer and improved reliability in separating the sheet from the image receiver.

An image-transfer and sheet-separating apparatus according to another aspect transfers toner retained on the image receiver onto a copy sheet, and separates the sheet from the image receiver upon the transfer process. The apparatus includes a transfer roller which presses on the image receiver, and to which DC and AC voltages are applied.

In this apparatus, when a copy sheet is transported between the image receiver and the transfer roller, AC voltage is applied to the transfer roller for a predetermined interval (specifically, the interval during which the non-image containing portion of the sheet along its forward margin passes through the nipping position), following which DC voltage to induce image transfer is applied to the roller. Accordingly, within the interval which is from the start point of an image-transfer process to the actual onset of image transfer, the forward-end part of the sheet is discharged by AC voltage, facilitating separation of the leading edge of the sheet from the image receiver. Consequently, the reliability of sheet separation is improved, meanwhile optimal efficiency of image transfer is maintained.

DESCRIPTION OF THE PREFERRED EMBODIMENTS

First Embodiment

Figure 1:
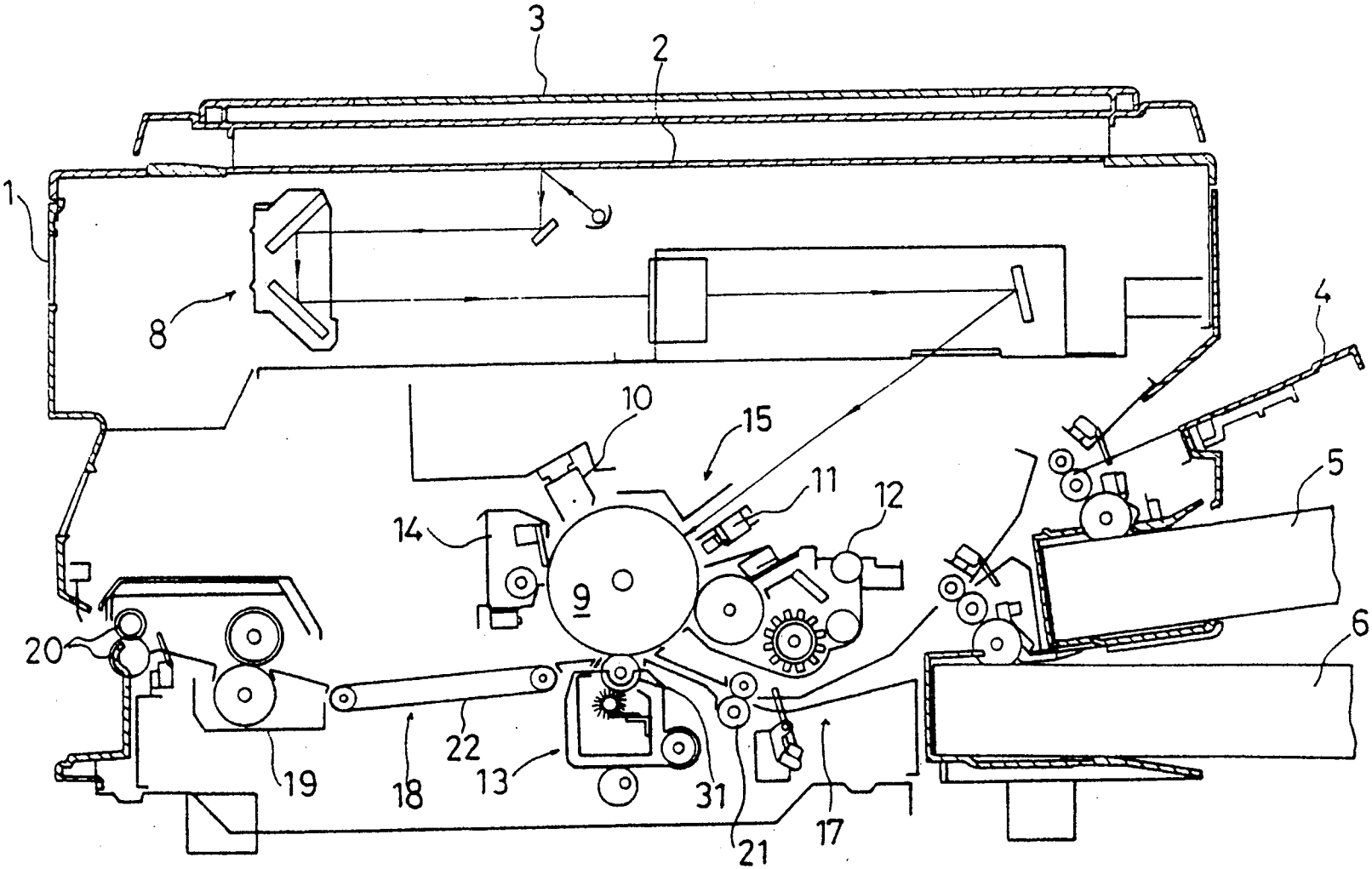
FIG. 1 is a schematic elevational view showing a copying machine incorporating a first embodiment according to the present invention.

In reference to FIG. 1, an original retainer 2 on which an original is retained is disposed in an upper portion of a copying machine body 1, and a raisable original cower 3 is provided over the upper surface of the original retainer 2. On the right side of the body 1 in the figure, a bypass tray 4 and detachable paper cassette cases 5 and 6 are attached.

Located in the tipper portion of the body 1 is an optical exposure system 8 for obtaining image information from the original. The optical exposure system 8 consists of a light source, mirrors, a lens unit, etc. In the central portion of the body 1 is an image-forming section 15 comprising a photoconductor drum 9 on which an electrostatic latent image is formed and, surrounding the photoconductor drum 9, a main charger 10 for electrically charging the photoconductor drum 9 to a predetermined level; a lamp 11 for discharging portions of a latent image on the photoconductor drum 9; a developing unit 12 for developing the electrostatic latent image on the photoconductor drum 9 with toner; an image-transfer and sheet-separating apparatus 13 for transferring the toner image from the photoconductor drum 9 onto a sheet:, and for separating the sheet therefrom; and a cleaning unit 14 for removing excess toner from the photoconductor drum 9.

Between each of the bypass tray 4, the paper cassette case 5, and the paper cassette case 6, respectively, and the image forming section 15, paper supply paths 17 are provided. In a portion of the sheet transport; stream forward of the image forming section 15, a sheet-discharging path 18 is provided. In a portion of the sheet transport stream rearward of the photoconductor drum 9, registration rollers 21 are provided, which regulate the start-timing for the transport of a copy sheet to between the photoconductor drum 9 and the image-transfer and sheet-separating apparatus 13. The sheet-discharging path 18 consists chiefly of a feed conveyer 22. In a portion of the sheet transport stream forward of the path 18, a fixing unit 19 for fixing a transferred toner image onto a transported sheet, and rollers 20 for discharging the sheet from the fixing unit 19, are also provided.

Figure 2:
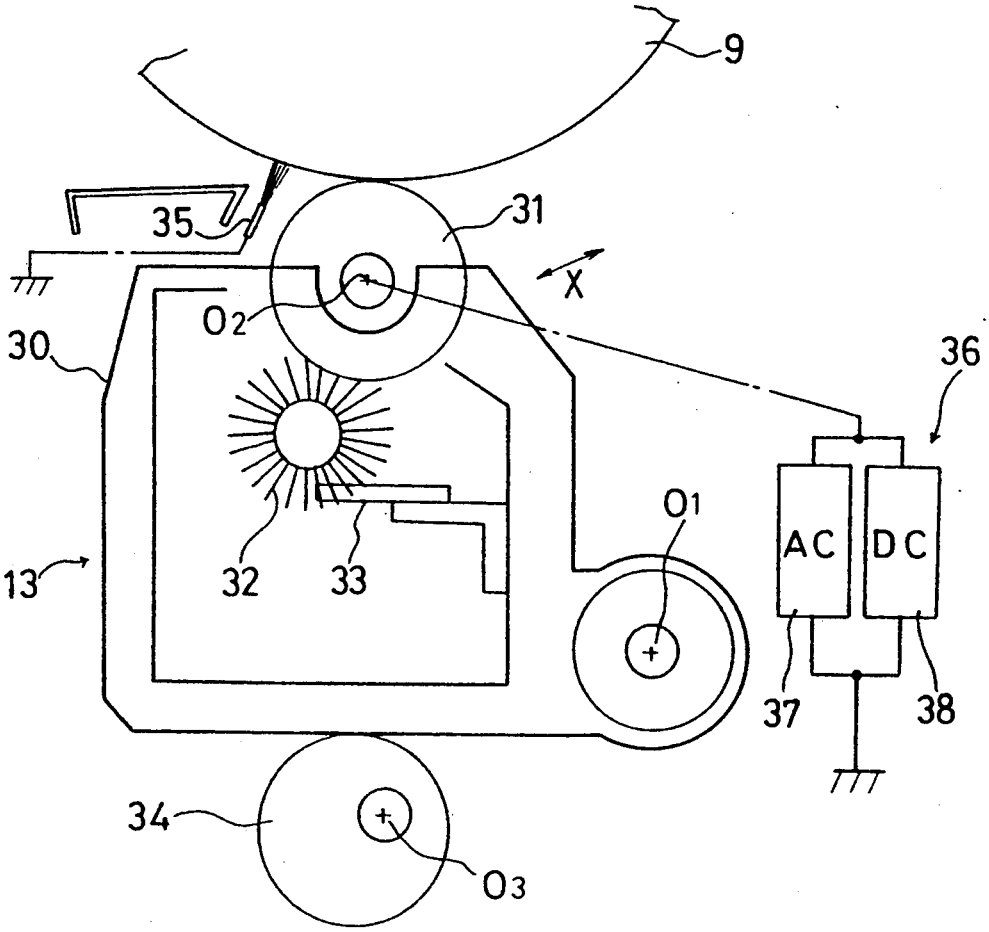
FIG. 2 is an enlarged sectional view showing the image-transfer and sheet-separating apparatus of the first embodiment.

In reference to FIG. 2, the image-transfer and sheet-separating apparatus 13 includes a case 30 pivotal along the direction indicated by arrow X about an axis $O_1$. In an upper portion of the case 30, a transfer roller 31 is rotatably supported about an axis $O_2$. The transfer roller 31 is formed from a pliable material, for example, polyurethane rubber, the resistivity of which is $10^7$ ohm centimeters and the hardness of which is 17 Shore A. An upper portion of the transfer roller 31 presses on the lower surface of the photoconductor drum 9, and the transfer roller 31 is connected to a bias power supply unit 36. The bias power supply unit 36 has an AC power supply 37 and a DC power supply 38 for applying AC and DC voltages respectively, and AC voltage superimposed on DC voltage is thereby applied to the transfer roller 31.

Within the case 30, a fibrous-brush cleaning roller 32 is disposed under and pressed against the lower surface of the transfer roller 31. The brush roller 32 is rotated by a not-indicated driving mechanism, and cleans the surface of the transfer roller. Into a lower portion of the brush roller 32, the tip of a blade 33 fixed to an inner wall of the case 30 extends. The blade 33 scrapes toner from the brush roller 32.

Under the case 30, a eccentric wheel 34 rotatable about an axis $O_3$ is disposed. Rotation of the eccentric wheel 34 about the axis $O_3$ shifts the image-transfer and sheet-separating apparatus 13 along the direction X in FIG. 2. The turning angle of the eccentric wheel 34 is between to correspond to the thickness of a copy sheet. The axes $O_1$, $O_2$ and $O_3$ lie in parallel.

In a portion of the sheet transport stream forward from the transfer roller 31, a charge-stripping brush 35 for removing charge from the reverse surface or the copy sheet is disposed. The charge-stripping brush 35 is of approximately the same length as the axial dimension of the transfer roller 31, and along the adjacent edge are conductive fibers of, for example, carbon. The tips of the charging-stripping brush 35 come into contact with the reverse surface of the copy sheet, and the opposite edge of the brush 35 is grounded. Accordingly, remnant charge on the sheet is removed.

Figure 3:
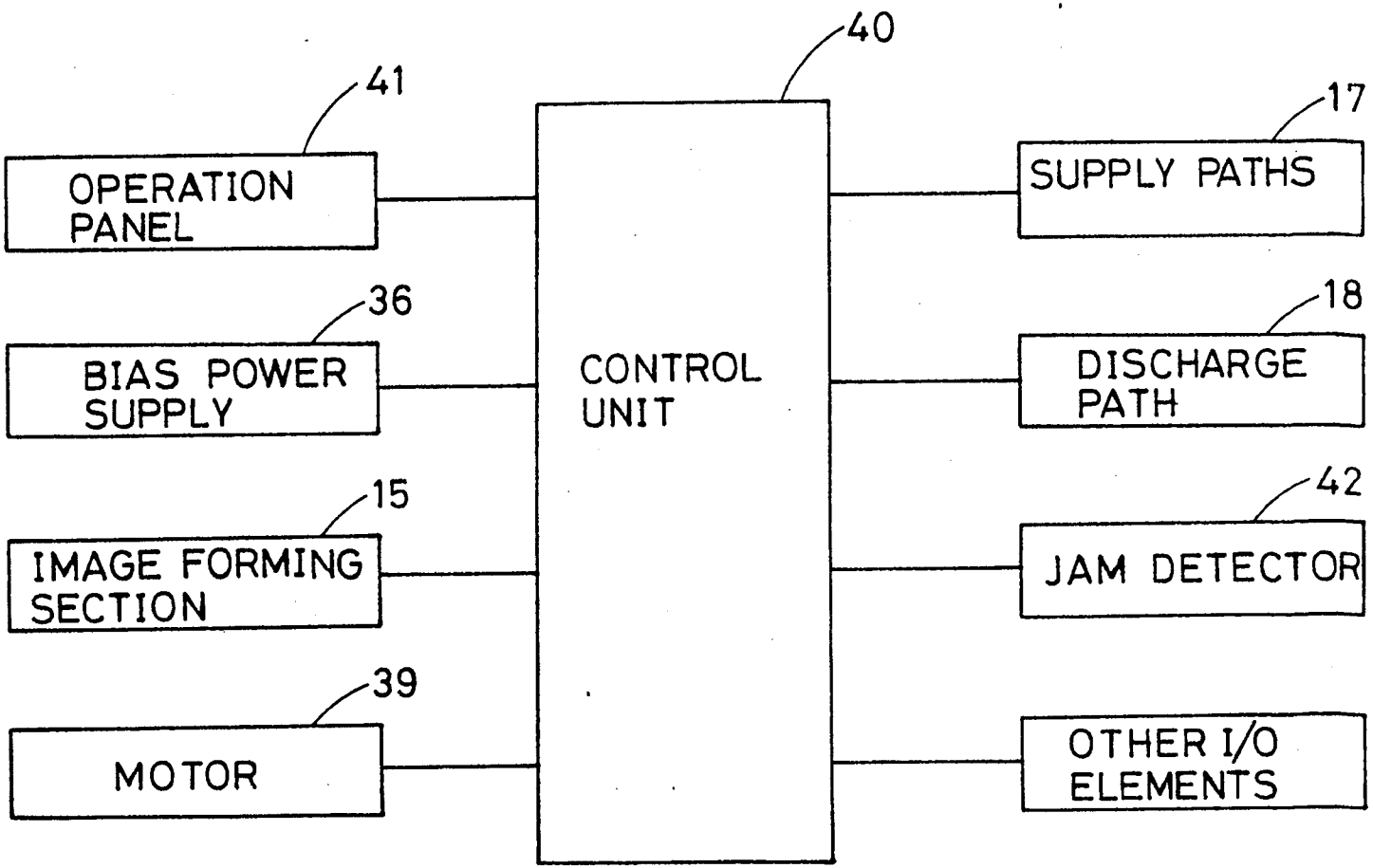
FIG. 3 is a block diagram illustrating a control unit of the first embodiment.

The copy machine includes a control unit 40 which is a microcomputer comprising a CPU, a ROM, a RAM etc., as shown FIG. 3. The control unit 40 is connected with an operation panel 41 disposed in the upper surface of the body 1. The operation panel 41 contains switches and an LED indicator. The control unit 40 is further connected with the bias power supply unit 36, a motor 39 for rotatively driving the transfer roller 31, a jam detector 42 composed of jam-detecting sensors provided in the supply paths 17 and the sheet-discharging path 18, and other input/output elements.

Figure 4:
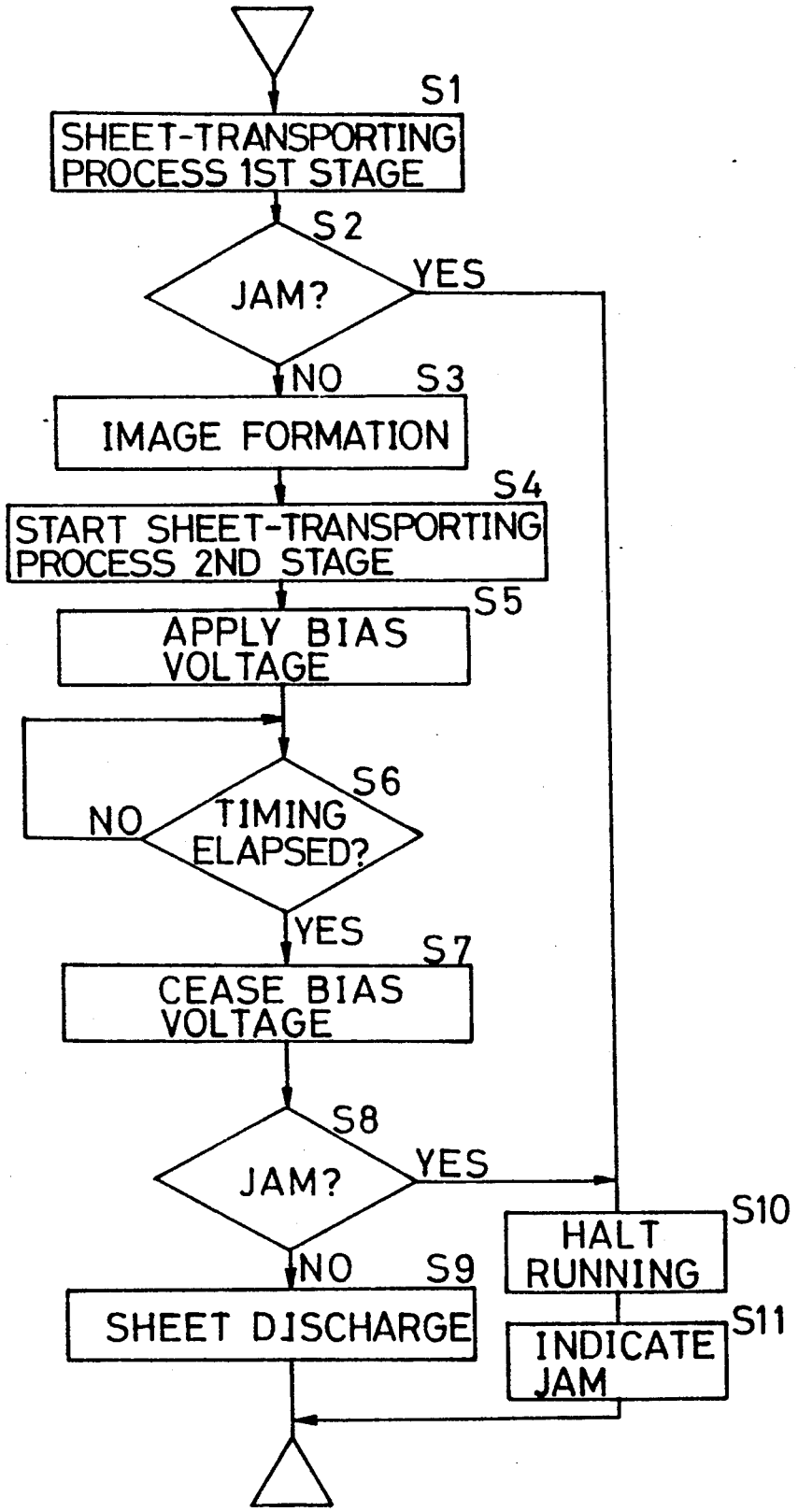
FIG. 4 is flowchart showing process control in the first embodiment.

The operation of the above embodiment will be described with reference to the flowchart shown in FIG. 4.

When a copying operation is started by pressing a print key in the operation panel 41, at step 1, the first stage in a sheet-transporting process is performed. In this first stage, a copy sheet is transported from a selected one of the paper cassettes to the registration rollers 21 via corresponding supply path 17. It then is determined at step S2 whether a jam has occurred during the first stage of the sheet-transporting process. This determination is made according to the status of the sensors in the jam detector 42. If no jam has occurred, the program runs to step S3.

At step S3, an image forming process is performed by the image forming section 15. In this step, the optical exposure system 8 obtains image information from the original on the original retainer 2. An electrostatic latent image is formed on the photoconductor drum 9 corresponding to the image information. Regions of the electrostatic latent image to be blanked are discharged by the blanking lamp 11, after which the latent image is developed with toner by the developing unit 12.

Once the toner image has been formed, at step S4, the registration rollers 21 start to rotate at that timing wherein the forward end of the toner image on the drum 9 will be coincident with the forward end of the sheet, whereupon the second stage of the sheet-transport process, which includes image transfer and sheet discharge, is performed. At step S5, a bias voltage consisting of an AC voltage superimposed on a DC voltage is applied to the transfer roller 31, and the transfer process is started. Therein, the sheet is charged by the DC voltage component with a charge of polarity reversed to that of the toner, and accordingly the toner image is transferred from the photoconductor drum 9 onto the sheet. Thereupon, the sheet is electrically discharged by the AC voltage; accordingly the possibility of separating failure is decreased.

At step S6, the program awaits the elapse of a timing corresponding to the circumferential length of the toner image on the photoconductor drum 9. When the timing has elapsed, the program proceeds to step S7. At step S7, application of the bias voltage is ceased, and the transfer process ends. It is determined at step S8 whether a jam has occurred in the second sheet-supplying process. If no jam has occurred, step S9 is executed. At step S9, the sheet-discharging path 18, the fixing unit 19 and the discharging rollers 20 are driven, and accordingly the sheet is discharged from the machine body 1.

On the other hand, if the determination at step S2 or S8 is YES, step S10 is executed in order to halt the running of all components. At step S11, the jam LED indicator In the operation panel 41 is illuminated, and an operator is thus notified that a jam has occurred. When the execution of either step S9 or step S11 has ended, the program proceeds to further steps.

Concrete examples of bias voltages employed in the sheet-separating function will be given in the following. Table 1 shows comparative examples using a DC bias voltage together with a charge-stripping element, and Table 2 shows embodiment examples using AC voltage superimposed on DC voltage in conjunction with the charge-stripping element.

TABLE 1

| Comparative Examples | DC (V) | Image Density | Separation Ability (Blank Sheet) |
|---|---|---|---|
| 1 | 500 | 1.187 | ○ |
| 2 | 1000 | 1.432 | x |
| 3 | 1500 | 1.486 | x |
| 4 | 2000 | 1.479 | x |
| 5 | 2500 | 1.473 | x |

TABLE 2

| | AC | | | | Separation |
|---|---|---|---|---|---|
| Examples | Frequency (Hz) | $V_{P-P}$ (V) | DC (V) | Image Density | Ability (Blank Sheet) |
| 1 | 500 | 500 | 500 | 1.286 | ○ |
| 2 | | 1000 | 1000 | 1.365 | ○ |
| 3 | | 1500 | 1500 | 1.443 | ○ |
| 4 | | 2000 | 2000 | 1.462 | Δ |
| 5 | 1000 | 500 | 500 | 1.273 | ○ |
| 6 | | 1000 | 1000 | 1.394 | ○ |
| 7 | | 1500 | 1500 | 1.458 | ○ |
| 8 | | 2000 | 2000 | 1.470 | ○ |
| 9 | 1500 | 500 | 500 | 1.302 | ○ |
| 10 | | 1000 | 1000 | 1.386 | ○ |
| 11 | | 1500 | 1500 | 1.451 | ○ |
| 12 | | 2000 | 2000 | 1.459 | Δ |

In Tables 1 and 2, a circle "○" indicates that no jam occurred when a blank sheet was transported; a triangle "Δ" indicate that some form of jamming occurred; and an "x" indicates that sheet separation was not executed satisfactorily, such that severe jamming occurred.

As is apparent from Table 1, in the cases wherein only DC bias voltage is used in the positive-image development process image density (ID) does not attain the 1.3 mark (on an arbitrary scale of comparison), below which inadequate image transfer efficiency is indicated, or more unless the bias voltage applied is 1000 V or greater. Furthermore, wherein the bias voltage applied is 1000 V or greater, the charge-stripping element is incapable of stripping sufficient charge, such that the sheet is not separated from the photoconductor drum.

In contrast, the application of AC voltage superimposed on DC voltage provides toner-developed images of sufficient density with bias voltages of 500 to 2000 V, meanwhile sheet separation is executed satisfactorily. It is apparent from Table 2 that the more preferable range of AC voltage is 1000 to 1500 V, regardless of frequency, and that the more preferable range of DC voltage is 1000 to 1500 V. In this range, when the bias voltage comprising AC superimposed on DC is applied, the image transfer efficiency is optimal and sheet separation is executed reliably.

Second Embodiment

Figure 5:
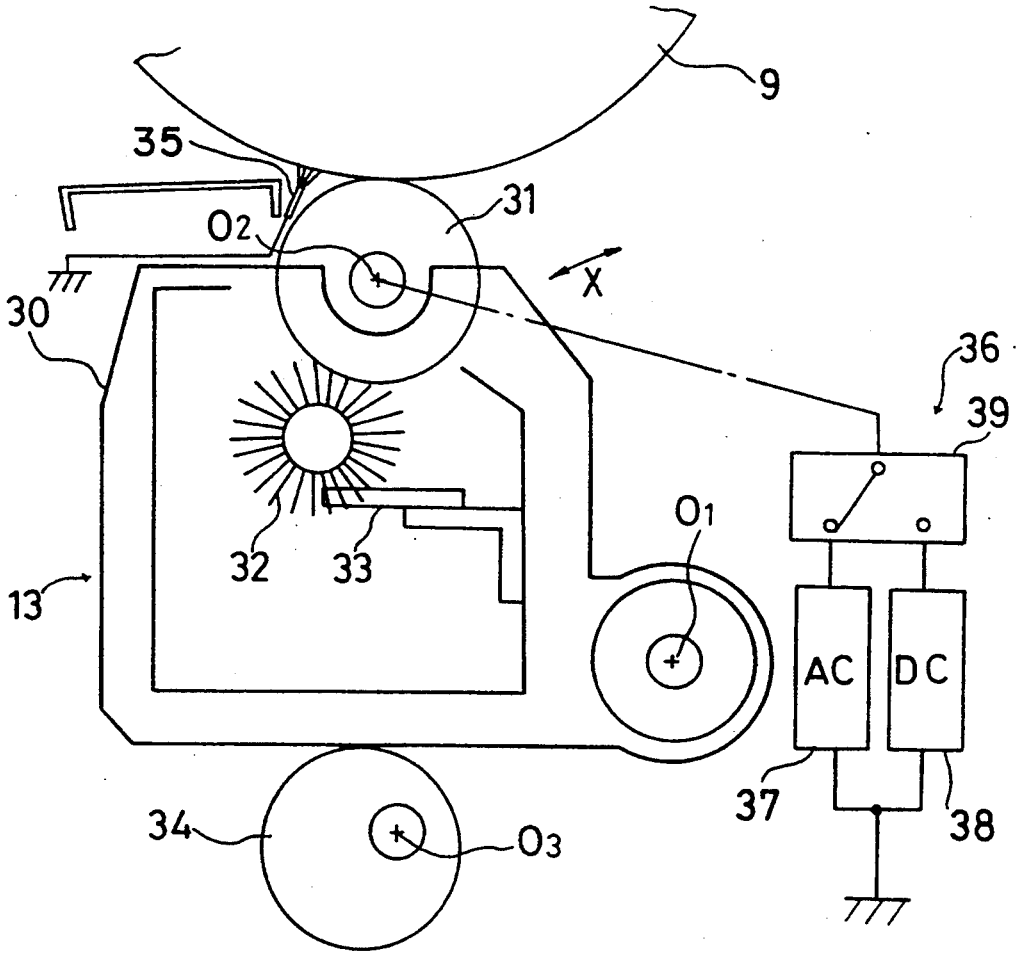
FIG. 5 is a view of a second embodiment, corresponding to FIG. 2.

In this embodiment, a bias power supply unit 36 as seen in FIG. 5 includes an AC power supply 37, and a DC power supply 38, and a switch 39 for switching between either one; and accordingly the bias power supply unit 36 is capable of selectively supplying either AC voltage or DC voltage.

Figure 6:
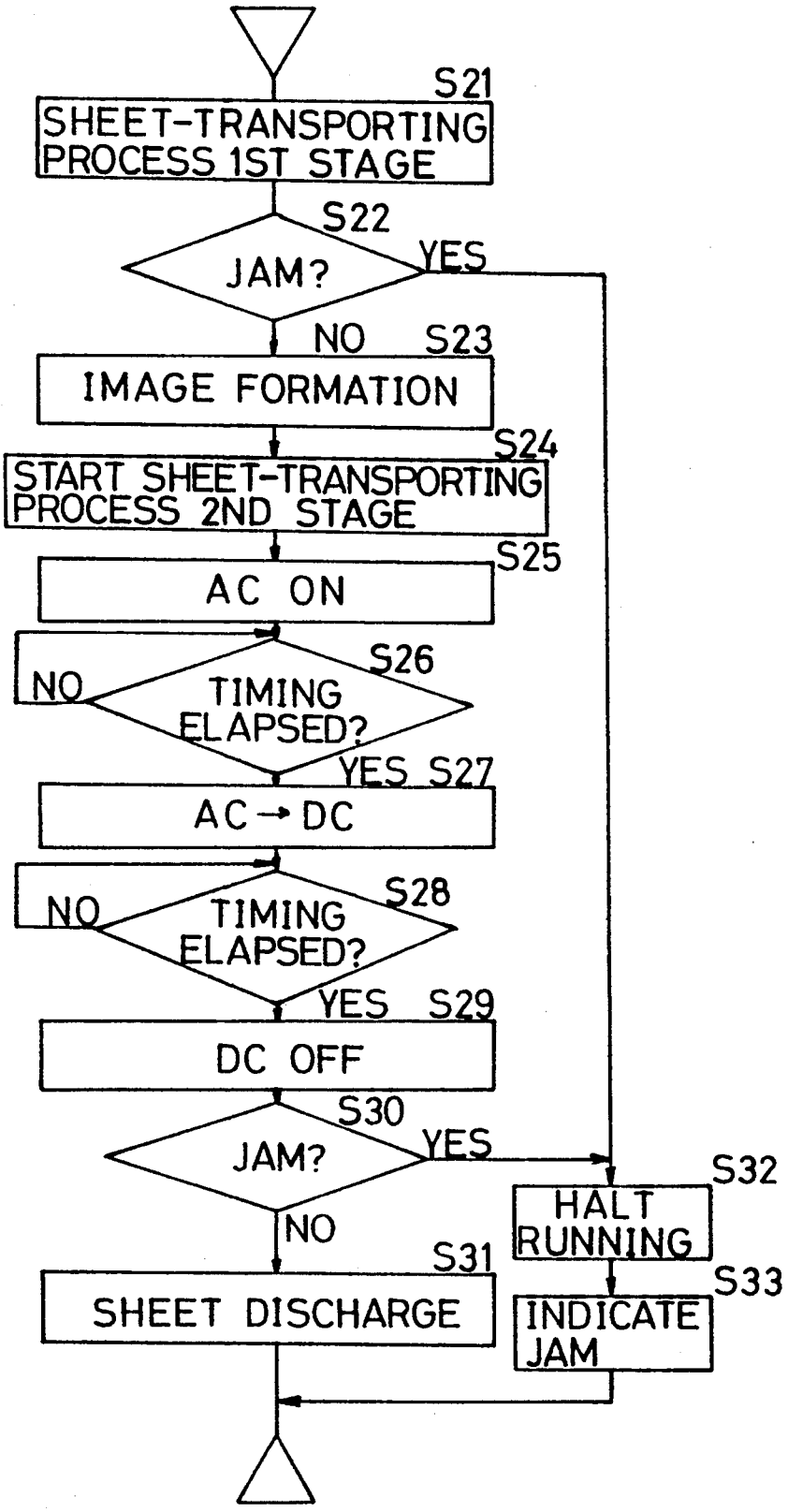
FIG. 6 is a flowchart pertaining to the second embodiment, corresponding to FIG. 4.

The operation of the second embodiment will be described with reference to the flowchart shown in FIG. 6.

As the print key in the operation panel 41 is pressed, the first stage in the sheet-transporting process, which supplies a sheet from a selected of the paper cassettes to the registration rollers 21 via the corresponding supply path 17, is carried out at step S21. At step S22, it is determined whether sheet jamming has occurred in the first stage sheet-transporting process. This determination is made according to the status of the sensors comprising the jam detector 42. If no jam has occurred, the program proceeds to step S23.

At step S23, an image forming process is carried out by the image forming section 15. In this process, the optical exposure system 8 obtains image information from the original on the original retainer 2, and an electrostatic latent image is formed on the photoconductor drum 9 corresponding to the image information. Regions of the electrostatic latent image on the photoconductor drum 9 to be blanked are discharged by the blanking lamp 11, after which the latent image is developed with toner by time developing unit 12.

At step S24, the registration rollers 21 start to rotate at that timing wherein the forward end of the toner image on the drum 9 will be coincident with the forward end of the sheet, and thereupon the second stage of the sheet-transport process, for image transfer and sheet discharge, is carried out. At step S25, the switch 39 of the bias power supply unit 36 is changed over to the AC power supply 37, switching it on, whereby AC bias voltage is applied to the transfer roller 31. Accordingly, the sheet is discharged and its forward end is separated from the photoconductor drum 9. The program awaits elapse of the predetermined timing at step S26. The predetermined timing is equivalent to that interval till the non-Image area of the forward end of a sheet (about 5 mm in length from the sheet's tip) passes the nipping position.

When the timing has elapsed, the program runs to step S27. There, the switch 39 is changed over to the DC power supply 38, switching it on, shifting the voltage from AC to DC bias voltage. Thus the image transfer process is started, and accordingly the toner image on the photoconductor drum 9 is transferred to the sheet. AT step S28, the program awaits a timing corresponding to the circumferential length of the toner image on the photoconductor drum 9.

When the timing of step S28 has elapsed, the program proceeds to step S29. At step S29, the DC power supply 39 is switched off, accordingly the application of bias voltage is stopped and the image transfer process ends. At step S30, it is determined whether jamming has occurred in the second sheet-supplying process, if not, the program proceeds to step S31. At step S31, the sheet-discharging path 18, the fixing unit 19 and discharging rollers 20 are driven respectively; and accordingly the sheet is discharged from the body 1.

On the other hand, wherein it is determined that a jam has occurred at either step S22 or S30, the program proceeds to step S32. At step S32, all running components are halted. At step S33, the jam LED indicator in the operation panel 41 is illuminated, notifying an operator that a jam has occurred. After the execution of either step S31 or step S33, the program proceeds to subsequent steps.

In this embodiment, AC voltage is applied to the transfer roller while the non-image area in the forward end of the sheet is in the nipping position, thereby the non-image area on the sheet is discharged, accordingly separating the forward end of the sheet from the photoconductor drum 9 such that it cannot be re-attracted by the photoconductor drum.

Modifications (a) In the above embodiments, the present invention is applied to a copying machine; however, the present invention may be applied to other image forming apparatus such as a laser-printer, etc.

(b) In the foregoing embodiments, the toner-developed image is transferred from a photoconductor drum to a sheet, however the present invention may be applied in cases such as those wherein a toner image is transferred from a transfer drum or a transfer belt, as in a color copying machine.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An apparatus for transferring onto a sheet an image, retained on an image receiver and toner-developed from a positive latent image, and for subsequently separating said sheet from said image receiver, comprising:

a transfer roller pressing on said image receiver;

means for applying to said transfer roller AC voltage and DC voltage, said voltage applying means including a.) a power supply unit connected with said transfer roller and having AC and DC power supply sections, such that said DC power supply section, in applying a DC bias voltage to said transfer roller, charges said sheet with a charge having a polarity opposite to a toner charge that causes said toner-developed image to adhere to said image receiver, said opposite polarity charge inducing transfer of said toner-developed image from said image receiver onto said sheet, and said AC power supply section applies an AC voltage to said transfer roller in order to electrically discharge said sheet; and b.) a switch for electrically connecting either said AC power supply section or said DC power supply section to said transfer roller;

a control unit for selectively applying either said AC or DC voltage to said transfer roller by switching of said switch, wherein said control unit changes said switch such that the AC voltage is applied to said transfer roller when a transport-forward end of said sheet is located between said transfer roller and said image receiver, and such that subsequently the DC voltage is applied to said transfer roller; and a charge-stripping brush for removing electric charge from said sheet, said brush being provided in a position forward of said transfer roller in a transport direction of said sheet during the image transferring, said brush having an edge that contacts a surface of said sheet opposite to that containing said transferred toner-developed image.

2. An apparatus according to claim 1, wherein said image receiver is a rotatable photoconductor drum.

3. An apparatus according to claim 2, wherein said transfer roller is disposed in a position under and axially parallel with said photoconductor drum.

4. An apparatus according to claim 3, further comprising means for approaching said transfer roller to and retreating it from said photoconductor drum.

5. An apparatus according to claim 4, further comprising a case, an upper portion of which rotatably supports said transfer roller, wherein said case is provided under said photoconductor drum.

6. An apparatus according to claim 5, wherein said case is pivotally supported along one end of an underside thereof.

7. An apparatus according to claim 6, wherein said approaching/retreating means includes a rotatable eccentric wheel in contact with said underside of said case.

8. An apparatus according to claim 7, wherein a turning angle of said eccentric wheel is determined corresponding to a thickness of said sheet.

9. An apparatus according to claim 5, further comprising:

a fibrous brush roller rotatably provided in said case and pressing on a lower surface of said transfer roller; and a blade, having a tip extending into a lower portion of said fibrous brush roller, provided in said case.

10. An apparatus according to claim 1, wherein said charge-stripping brush contains conductive fibers.

11. An apparatus according to claim 10, wherein said conductive fibers are carbon fibers.

12. An apparatus according to claim 11, wherein said charge-stripping brush is grounded.

13. An image-forming apparatus comprising:

a scanning unit for obtaining image information corresponding to an original image;

an image forming unit including an image receiver for developing with toner, a latent image in positive correspondence to said image information retained on said image receiver; and an image-transfer and sheet-separating apparatus for transferring onto a sheet the toner-developed image retained on said image receiver, and for subsequently separating said sheet from said image receiver; wherein said image-transfer and sheet-separating apparatus includes a transfer roller pressing on said image receiver;

means for applying to said transfer roller AC voltage and DC voltage, said voltage-applying means including a.) a power supply unit connected with said transfer roller and having AC and DC power supply sections, and b.) a switch for electrically connecting either said AC power supply section or said DC power supply section to said transfer roller;

a control unit for selectively ,applying either said AC or DC voltage to said transfer roller through switching said switch; wherein said control unit-changes said switch such that the AC voltage is applied to said transfer roller when a transport-forward end of said sheet is located between said transfer roller and said image receiver, and such that subsequently the DC voltage is applied to said transfer roller; and a charge-stripping brush for removing electric charge from said sheet, provided in a position forward of said transfer roller in a transport direction of said sheet during the image transferring, wherein an edge of said brush contacts a surface of said sheet opposite to that containing said transferred toner-developed image.

14. An apparatus according to claim 13, wherein said image receiver is a rotatable photoconductor drum, and said transfer roller is disposed in a position under and axially parallel with said photoconductor drum.

15. An apparatus according to claim 14, further comprising a case, an upper portion of which rotatably supports said transfer roller, wherein said case is provided under said photoconductor drum.

16. An apparatus according to claim 15, wherein said case is pivotally supported along one end of an underside thereof.

17. An apparatus according to claim 26, further comprising a rotatable eccentric wheel in contact with said underside of said case, wherein a turning angle of said eccentric wheel is determined corresponding to a thickness of said sheet.

18. An apparatus according to claim 15, further comprising:

a fibrous brush roller rotatably provided in said case and pressing on a lower surface of said transfer roller; and a blade, having a tip extending into a lower portion of said fibrous brush roller, provided in said case.

19. An apparatus according to claim 18, wherein said charge-stripping brush is grounded.

* * * * *